US011122842B2

(12) United States Patent
Blake et al.

(10) Patent No.: US 11,122,842 B2
(45) Date of Patent: Sep. 21, 2021

(54) HOOD INCLUDING PARTICLE BARRIER

(71) Applicants: W. L. Gore & Associates, Inc., Newark, DE (US); W. L. Gore & Associates GmbH, Putzbrunn (DE)

(72) Inventors: Holly Blake, Newark, DE (US); Seth Harper, Newark, DE (US); Allen Maples, Newark, DE (US); Shawn Riley, Newark, DE (US); Bernd Zischka, Putzbrunn (DE); Werner Stübiger, Putzbrunn (DE)

(73) Assignees: W. L. Gore & Associates, Inc., Newark, DE (US); W. L. Gore & Associates GMBH, Putzbrunn (DE)

( * ) Notice: Subject to any disclaimer, the term of this patent is extended or adjusted under 35 U.S.C. 154(b) by 65 days.

(21) Appl. No.: 16/473,908

(22) PCT Filed: Jan. 4, 2018

(86) PCT No.: PCT/US2018/012397
§ 371 (c)(1),
(2) Date: Jun. 26, 2019

(87) PCT Pub. No.: WO2018/129195
PCT Pub. Date: Jul. 12, 2018

(65) Prior Publication Data

US 2019/0350290 A1 Nov. 21, 2019

Related U.S. Application Data

(60) Provisional application No. 62/443,057, filed on Jan. 6, 2017.

(51) Int. Cl.
*A41D 13/11* (2006.01)
*A41D 31/08* (2019.01)
(Continued)

(52) U.S. Cl.
CPC ..... *A41D 13/1153* (2013.01); *A41D 31/085* (2019.02); *A42B 1/046* (2013.01);
(Continued)

(58) Field of Classification Search
CPC .... A42B 1/046; A41D 31/085; A41D 31/145; A41D 13/1153; A41D 13/1218; A41D 13/1245; A62B 17/04; A62B 17/003
(Continued)

(56) References Cited

U.S. PATENT DOCUMENTS 4,573,217 A * 3/1986 Reed ..... A42B 1/045 128/201.23
4,602,385 A * 7/1986 Warren ..... A41D 13/0153 2/2.14
(Continued)

FOREIGN PATENT DOCUMENTS

EP 0 157 140 A1 10/1985
GB 109825 A * 9/1917 ..... A42B 1/046
(Continued)

OTHER PUBLICATIONS

Honeywell LifeGuard(TM) Hood press release, Jul. 25, 2016.
(Continued)

*Primary Examiner* — Khoa D Huynh
*Assistant Examiner* — Grace Huang
(74) *Attorney, Agent, or Firm* — Greenberg Traurig, LLP

(57) ABSTRACT

Disclosed are protective hoods including particle barrier layers to reduce or prevent penetration of the hoods by particulates in the environment of a wearer. The particle barrier layer of a hood is accessible when the hood is intact. A hood described herein optionally includes an aperture for accessing the particle barrier layer. A hood described herein optionally includes a face opening that engages with a face mask to form a protective seal. A hood described herein
(Continued)

optionally includes a visual indicator to indicate when the hood is properly positioned with respect to a face mask.

20 Claims, 5 Drawing Sheets

(51) Int. Cl.

| | |
|---|---|
| ***A42B 1/046*** | (2021.01) |
| ***A41D 31/02*** | (2019.01) |
| *A62B 17/04* | (2006.01) |
| *A41D 31/14* | (2019.01) |
| *A62B 17/00* | (2006.01) |

(52) U.S. Cl.
CPC ..... *A41D 31/02* (2013.01); *A41D 31/145* (2019.02); *A62B 17/003* (2013.01); *A62B 17/04* (2013.01)

(58) Field of Classification Search
USPC ..... 2/7, 424, 456, 457
See application file for complete search history.

(56) References Cited

U.S. PATENT DOCUMENTS 4,637,383 A * 1/1987 Lopez ..... A62B 17/04 128/201.25
4,774,728 A * 10/1988 Carnicella ..... A41D 27/08 112/155
4,870,959 A * 10/1989 Reisman ..... A62B 17/04 128/201.25
5,014,357 A * 5/1991 Wiseman, Sr. ..... A62B 17/003 2/458
5,090,054 A * 2/1992 Grilliot ..... A42B 1/048 2/202
5,655,222 A * 8/1997 Grilliot ..... A62B 17/003 2/81
6,006,360 A * 12/1999 Reed ..... A42B 3/105 2/202
6,018,821 A * 2/2000 Adams ..... A42B 1/02 2/175.1
6,260,207 B1 * 7/2001 Barbeau ..... A42B 3/105 2/202
6,543,450 B1 * 4/2003 Flynn ..... A62B 18/02 128/201.25
6,691,317 B2 * 2/2004 Cochran ..... A41D 27/04 2/81
8,225,428 B2 * 7/2012 Grilliot ..... A42B 1/048 2/202
8,631,516 B2 * 1/2014 Hofmann ..... A62B 17/006 2/84
9,707,106 B2 * 7/2017 Egilsson ..... A61F 2/7812
9,707,504 B2 * 7/2017 Chaen ..... C08L 83/04
10,111,482 B2 * 10/2018 Brandt ..... A42C 5/04
10,478,644 B2 * 11/2019 Leggett ..... A42B 1/041
10,582,758 B1 * 3/2020 DeMeo ..... A41F 1/02
2004/0060102 A1 * 4/2004 Brookman ..... A62B 17/006 2/457
2005/0060788 A1 * 3/2005 Green ..... A41D 13/1153 2/171.3
2005/0144695 A1 7/2005 Aldridge et al.
2007/0174944 A1 * 8/2007 Grilliot ..... A42B 3/10 2/84
2009/0025112 A1 * 1/2009 Corsini ..... A42B 1/046 2/7
2009/0155564 A1 * 6/2009 Bansal ..... B01D 67/0079 428/305.5
2009/0205116 A1 * 8/2009 Stone ..... B01D 69/12 2/455
2009/0246485 A1 * 10/2009 Panse ..... B32B 5/22 428/201
2010/0288273 A1 * 11/2010 Sandlin ..... A62B 17/04 128/201.24
2010/0316819 A1 * 12/2010 Bansal ..... B32B 27/08 428/35.7
2010/0319113 A1 * 12/2010 Rock ..... A62D 5/00 2/457
2015/0065002 A1 * 3/2015 Benaddi ..... B32B 5/026 442/268
2016/0213960 A1 * 7/2016 Crotty ..... B32B 5/16
2018/0207453 A1 * 7/2018 Barbeau ..... B32B 5/024
2020/0022424 A1 * 1/2020 Wenzel ..... B32B 5/026
2020/0069980 A1 * 3/2020 Sonntag ..... A62B 17/003

FOREIGN PATENT DOCUMENTS

GB 1603268 A * 11/1981 ..... A42B 1/046
JP 10258131 A * 9/1998
WO 2004/105880 A1 12/2004
WO 2013/044009 A1 3/2013
WO WO-2017214390 A1 * 12/2017 ..... B32B 5/00

OTHER PUBLICATIONS

International Search Report and Written Opinion from International Application No. PCT/US2018/012397 dated Jun. 1, 2018.

* cited by examiner

HOOD INCLUDING PARTICLE BARRIER

RELATED APPLICATIONS

The present application is a national phase filing under 35 USC 371 of International Application No. PCT/US2018/012397, filed on Jan. 4, 2018, which claims the benefit of U.S. Provisional Application No. 62/443,057, filed Jan. 6, 2017, the entire contents and disclosures of which are hereby incorporated by reference in their entirety.

FIELD

The field relates generally to flexible protective hoods, and more specifically to flexible hoods comprising a particle barrier layer for preventing or inhibiting penetration of particulates, including aerosols and, potentially, vapors. The hoods may be used in environments that expose the wearer to smoke, aerosols, and other particulates.

BACKGROUND

Fabrics, particularly for clothing, with protective properties are desired. They are typically used in so-called Personal Protective Equipment (PPE) for protection in working environments like for firefighting. Current practices in firefighting protective ensembles or manufacturing PPE includes a protective hood that stretches over a user's head with an opening for the mask of a self-contained breathing apparatus (SCBA) and a bib that extends under the top of the firefighter's coat. Generally, the hoods are formed from two layers of knit material. Currently, these hoods allow particulates, such as those in smoke, to penetrate into the interior of the hood and expose the wearer to potentially hazardous particulates.

Hoods have also been proposed that include particulate barriers to reduce penetration of particulates through the hood material and into the interior of the hood where they can contact the skin of a wearer. Known hoods having particulate barriers suffer from a number of drawbacks. For example, the particulate barriers can be too stiff, making them uncomfortable to wear, they can lack durability and/or they can impair sound transmission. In addition, the barrier layer is internal to the hood and is not visible or accessible without irreversibly disassembling or damaging the hood. Some barrier layers may be less durable than the other fabrics and tears may cause holes to develop. The holes may expose the wearer to the accumulated particulates. If the barrier layer is not accessible, the wearer cannot determine whether the barrier is clean, intact, and safe to use or if the barrier is clogged with particulates, torn, or otherwise damaged and unreliable. Additionally, head coverings in cold environments such as in winter and mountain sports are also formed from one or two layers of knitted materials. In bad weather conditions, these hoods can allow snow and sleet particulates to penetrate into the interior of the hood and expose the wearer to cold.

U.S. Pat. No. 6,763,835 describes a respiratory mask assembly for filtering airborne biological and/or chemical agents from air for breathing, comprising an outer hood adapted to seal with and encompass at least the head and neck of a wearer from ambient atmosphere, at least one transparent lens attached to the outer hood for providing visual sight to the wearer, at least one filter assembly attached to the outer hood, the filter assembly adapted for filtering airborne biological and/or chemical agents from air passing therethrough, an airflow regulator located in the outer hood, the airflow regulator including an outlet adapted for expelling exhaled air to ambient, and an inlet adapted for drawing air thereinto, and air conveying means located in the outer hood for conveying air filtered through the filter assembly from ambient to the inside surface of the transparent lens for drawing into the airflow regulator inlet.

U.S. Patent Application Publication No. 2012/0174296 describes chemical and/or biochemical resistant protective garments that include a top part having a body portion and sleeves, the body portion having a vapor skirt that is self-tightenable towards the torso of a wearer, and a bottom part having a fold-over waistband extension, a waistband, a seat portion, and left and right leg portions, the fold-over waistband extension being foldable over the waistband to reveal a backside of the fold-over waistband extension when the bottom part is worn by the wearer. When the top and bottom parts are worn by the wearer, the vapor skirt is positioned against the backside of the fold-over waistband and is self-tightened thereagainst as a seal that is generally impermeable to gases.

Accordingly, a need exists for a protective hood that includes a particle barrier layer that prevents or inhibits particulates penetrating to the interior of the hood where they can be exposed to a wearer.

SUMMARY

Embodiments described herein provide protective hoods comprising a particle barrier layer to reduce or inhibit penetration of particulates.

One embodiment described herein is a hood, for example, a protective hood for a wearer comprising a first layer and a particle barrier layer that at least partially covers the first layer. The particle barrier layer comprises an interior surface toward the wearer and a particle collection surface opposite the interior surface. The hood comprises a head portion comprising a first peripheral edge defining a face opening, and the first layer and particle barrier layer are joined along at least a portion of the first peripheral edge. The hood further comprises a bib portion comprising a second peripheral edge defining a neck opening, and the first layer and particle barrier layer are joined along at least a portion of the second peripheral edge. The particle collection surface of the particle barrier layer is accessible. For example, the particle collection surface may be accessible for viewing and/or cleaning. Optionally, the hood may further comprise an inner surface and a heat resistant elastomer adhered to the inner surface adjacent to the first peripheral edge of the face opening.

Another embodiment described herein is a protective hood for a wearer comprising a first layer and a particle barrier layer that at least partially covers the first layer. The particle barrier layer comprises an interior surface toward the wearer and a particle collection surface opposite the interior surface. The hood comprises a head portion comprising a first peripheral edge defining a face opening, and the first layer and particle barrier layer are joined along at least a portion of the first peripheral edge. The hood further comprises a bib portion comprising a second peripheral edge defining a neck opening, and the first layer and particle barrier layer are joined along at least a portion of the second peripheral edge. The hood also comprises an inner surface and a heat resistant elastomer adhered to the inner surface adjacent to the first peripheral edge of the face opening. Optionally, the heat resistant elastomer is a silicone elastomer.

Another embodiment described herein is a protective hood for a wearer comprising a first layer and a particle barrier layer that at least partially covers the first layer. The particle barrier layer comprises an interior surface toward the wearer and a particle collection surface opposite the interior surface. The hood comprises a head portion comprising a first peripheral edge defining a face opening, and the first layer and particle barrier layer are joined along at least a portion of the first peripheral edge. The first peripheral edge defining the face opening comprises a visual indicator that the face opening is properly configured on a face mask. The hood further comprises a bib portion comprising a second peripheral edge defining a neck opening, and the first layer and particle barrier layer are joined along at least a portion of the second peripheral edge.

In any embodiment described herein, the first layer of the hood may comprise a textile layer.

In any embodiment described herein, the first layer may be adjacent to the particle collection surface, and the bib and/or the head portion may comprise at least one aperture to provide access to the particle collection surface of the particle barrier layer. Optionally, the aperture may be located along at least a portion of the second peripheral edge between the first layer and the particle barrier layer. Optionally, the aperture may have dimensions sufficient to invert the hood such that the particle collection surface is on the exterior of the hood.

In any embodiment described herein wherein the first layer is not adjacent to the particle collection surface, the particle barrier layer may be oriented such that in use the particle collection surface is on the exterior of the hood.

In any embodiment described herein, the interior surface of the particle barrier layer may be laminated to a substrate. Optionally, the substrate may be a knit, woven, nonwoven, or fleece. Optionally, the substrate may be in the form of a plurality of lines, a grid, a monolithic coating, etc.

In any embodiment described herein, the hood may further comprise a second layer, wherein the particle barrier layer is between the first layer and the second layer; or a second layer, wherein the first layer is between the particle barrier layer and the second layer; or a second layer and a third layer, wherein first layer and the particle barrier layer are in between the second layer and the third layer.

In any embodiment described herein, the hood can be constructed of two or more multi-panel layers and the seams joining the panels of one layer are offset when compared to the seams joining the panels of adjacent layers.

In any embodiment described herein, the hood can comprise two or more layers wherein each layer comprises at least one seam that is not a seam around at least a portion of the first or second peripheral edge and wherein the seam of one layer is offset when compared to the seam of the adjacent layer. In some embodiments, the seam of a particle barrier layer is offset from the seam of a first layer.

In any embodiment described herein, at least one of the layers may be a flame resistant textile layer. The flame resistant layer may comprise synthetic polymers, flame-resistant (FR) cotton, FR rayon, wool, or blends thereof. The synthetic polymer may comprise aramid, polyamide, polybenzimidazole (PBI), polybenzoxazole (PBO), polydiimidazo pyridinylene dihydroxy phenylene (PIPD), modacrylic, or blends thereof.

In any embodiment described herein, the particle barrier layer may be joined to the first layer and/or to at least one other layer along the portion of the second peripheral edge by stitching, an adhesive, lamination, or a combination thereof. Optionally, the first and second layers are joined to each other along at least a portion of the second peripheral edge. Optionally, the first, second and third layers are joined to each other along at least a portion of the second peripheral edge.

In any embodiment described herein, the hood may comprise two or more particle barrier layers. Optionally, the particle barrier layers may be adjacent to each other or may be separated from each other.

In any embodiment described herein, at least two layers selected from the particle barrier layer, the first layer, the second layer, and/or the third layer that are adjacent may be separable.

In any embodiment described herein, the particle collection surface or the particle barrier layer may be configured to release at least a portion of the particulates.

In any embodiment described herein, the particle barrier layer may comprise polytetrafluoroethylene (PTFE), expanded PTFE (ePTFE), another fluoropolymer, polyurethane, polyolefin (e.g., polyethylene, polypropylene), polyimide (e.g. NANO® and NANOFLEX® polyimides), polyester, silicone, or a combination thereof.

In any embodiment described herein the hood may comprise at least one aperture, and the at least one aperture may be a closeable opening comprising one or more slits, folds, overhangs, buttons, hook and loop closures (e.g., Velcro® fasteners), snaps, or any combination thereof.

In any embodiment described herein the hood may comprise a heat resistant elastomer, and the heat resistant elastomer may be configured to engage a face mask. Optionally, the heat resistant elastomer may be configured to frictionally engage a face mask.

In any embodiment described herein, the peripheral edge defining the face opening may comprise a visual indicator that the face opening is properly configured on a face mask. Optionally, the external surface of the hood comprises a color, the internal surface of the hood comprises a color, and the visual indicator is a seam comprising a color that is different than the color of the external surface of the hood, or the peripheral edge of the face opening comprises a seam sewn using a thread of a color different than the color of the internal or external surface of the hood.

These and other features will be described in more detail herein.

Covered embodiments are defined by the claims, not this summary. This summary is a high-level overview of various aspects and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

BRIEF DESCRIPTION OF THE DRAWINGS

The accompanying drawings are included to provide a further understanding of the disclosure and are incorporated in and constitute a part of this specification, illustrate embodiments, and together with the description serve to explain the principles of the disclosure.

DETAILED DESCRIPTION

Figure 1:
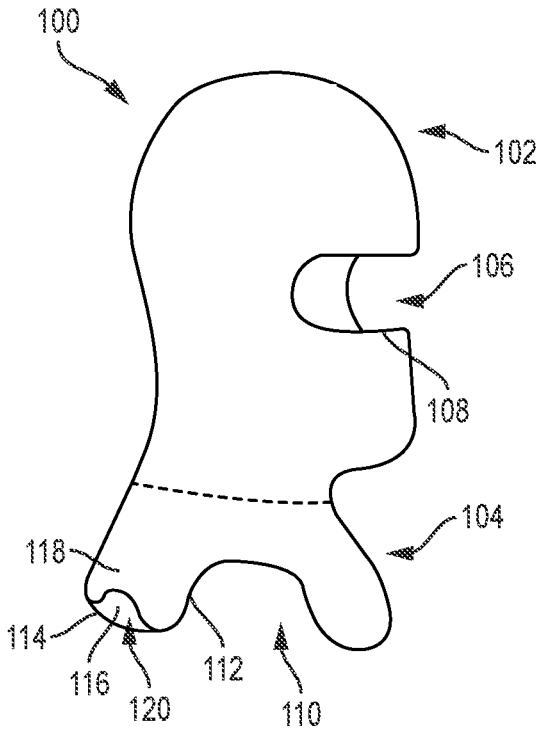
FIG. 1 is a side view of a protective hood according to embodiments described herein.

As used herein, the term "hood" refers to a stand-alone garment that is not a permanent part of any other garment. In some embodiments, the hood can be worn with a jacket, overalls, full-body suit, or other protective garment, for example with the jacket, overalls, full-body suit, or other protective garment donned over at least part of the bib portion, or with at least part of the bib portion tucked into the jacket, overalls, full-body suit, or other protective garment.

Protective hoods for use as personal protective equipment are described herein. The hoods include at least one particle barrier layer for preventing or inhibiting penetration of the hood by particulates in the environment of the wearer, including for example snow, sleet, soot, carbon, aerosols, vapors or a combination thereof. The hoods may be configured to also provide protection against other environments that expose the wearer to flames and/or heat, cold, and/or particulates.

The protective hoods disclosed herein comprise a head portion comprising a first peripheral edge defining a face opening or port and a bib portion comprising a second peripheral edge defining a neck opening. The hoods further comprise a particle barrier layer having an interior surface toward the wearer and a particle collection surface opposite the interior surface. The hoods also comprise at least one other layer that may be coextensive with the particle barrier layer or may have a surface area larger or smaller than the surface area of the particle barrier layer. The particle barrier layer and the additional layer are joined along at least a portion of the first peripheral edge defining the face opening. The particle barrier layer and the additional layer are also joined along at least a portion of the second peripheral edge defining the neck opening.

In some embodiments, a hood disclosed herein includes an aperture that provides access to the particle barrier layer for inspection and/or cleaning. In some embodiments, a hood disclosed herein includes a face opening that engages with a face mask to form a protective seal. In some embodiments, a hood disclosed herein includes a visual indicator to indicate when the hood is properly positioned with respect to a face mask.

The hoods disclosed herein include a particle barrier layer that can collect particulates having a diameter that is greater than or equal to 0.027 micrometers, or greater than or equal to 0.03 micrometers, or greater than or equal to 0.04 micrometers, or greater than or equal to 0.05 micrometers, or greater than or equal to 0.06 micrometers, or greater than or equal to 0.07 micrometers, or greater than or equal to 0.08 micrometers, or greater than or equal to 0.09 micrometers, or greater than or equal to 0.1 micrometers. These particulates may otherwise penetrate into the interior of the hood and expose the wearer to the particulates. For example, hoods are suitable for use in firefighter turnout gear, which in use are exposed to soot and other particulates. The particle barrier layer in the hoods can prevent at least a portion of the particulates in the environment of the firefighter or other wearer from penetrating the hood to contact the wearer's head and/or neck. The particle barrier layer may be used in combination with one or more other layers, including one or more textile layers, one or more flame resistant (FR) layers, one or more additional particle barrier layers, or combinations thereof.

One embodiment described herein is a protective hood for a wearer comprising a head portion and a bib portion. The head portion comprises a first peripheral edge defining a face opening. The bib portion comprises a second peripheral edge defining a neck/torso opening.

The hood further comprises a particle barrier layer having an interior surface toward the wearer and a particle collection surface opposite the interior surface. The particle collection surface faces toward the exterior environment and collects the particulates on or near the surface. Although, particulates may accumulate on the surface and a portion of the particulates may penetrate the pores of the particular barrier layer, it is believed that the majority of the particles do not reach the skin of the wearer. The hood also comprises at least one other layer, such as a support layer, inner layer, outer protective layer, or a combination thereof, that may be coextensive with the particle barrier layer or may have a surface area larger or smaller than the surface area of the particle barrier layer. In some embodiments, the particle barrier layer covers at least 10% or 20% or 30% or 50% or 60% of the at least one other layer, wherein the percentage is based on the total surface area of the exterior surface of the hood. When the barrier layer is not an exterior layer of the hood, the barrier layer may have a surface area that is up to about 25% or 50% or 75% or 100% greater than the surface area of the exterior surface of the hood.

The particle collection surface of embodiments described herein is accessible when the hood is intact. Accessibility is important because personnel relying on the protective hood must be able to clean particulates while leaving the hood intact. After one or more uses, particulates may build up on the surface or may penetrate the pores of the particular barrier layer. If enough particulates accumulate in/on the particle barrier layer certain advantageous properties, such as breathability, may be reduced. Also, if the particle barrier layer becomes damaged and develops tears or holes, it may lose its ability to prevent particulates from entering the interior of the hood and contacting a wearer. Accessibility allows a wearer to determine the condition of the particle barrier layer and may also allow the particle barrier layer to be cleaned or repaired prior to use.

In some embodiments, the particle collection surface is covered by one or more layers, and the hood comprises an aperture to provide access to the particle collection surface of the particle barrier layer. The aperture may provide visual access so that a wearer can determine if the particle barrier layer is sufficiently clean and intact to provide the desired protection. Additionally or alternatively, the aperture may provide access so that at least a portion of the particulates can be removed from the particle barrier layer, such that the particle barrier layer is at least partially cleaned. Additionally or alternatively, the aperture may provide access so that the particle barrier layer may be repaired, such as taping, welding, sewing, or otherwise securing a tear or replacing a portion of the barrier layer. In some embodiments, the aperture has dimensions sufficiently large to invert the hood such that the particle barrier layer may be exposed for viewing, cleaning, or repair and then returned to its original configuration for subsequent use. The aperture may be in the head portion of the hood, or may be in the bib portion of the hood. In some embodiments, the aperture may be located along at least a portion of the first or second peripheral edge. In alternative embodiments, the particle collection surface is accessible because it is the external surface of the hood.

FIG. 1 is a side perspective view of a protective hood 100 according to embodiments described herein. FIG. 1 illustrates an embodiment including a head portion 102 integral with a bib portion 104 thus forming an unitary construction. The head portion 102 includes a face opening 106 defined by a first peripheral edge 108. The bib portion 104 includes a neck/torso opening 110 defined by a second peripheral edge 112. The protective hood 100 includes a particle barrier layer 114 having a particle collection surface 116 adjacent to an outer layer 118 and an aperture 120 between the particle barrier layer 114 and the outer layer 118. In FIG. 1 the aperture 120 is along a portion the second peripheral edge 112 between the particle barrier layer 114 and the outer layer 118 to provide access to the particle barrier layer 114, and more specifically to the particle collection surface 116, beneath the outer layer 118. As used herein, the particle collection surface is facing toward the exterior environment and is a surface opposite of the wearer. The aperture 120 is shown along a portion of the second peripheral edge 112, but the location of an aperture is not limited, and the aperture could be located in any desired location on the hood, provided the aperture provides access to the particle collection surface 116. The aperture 120 may be reversibly sealable and have fasteners for closing the aperture. In some embodiments, the aperture may have a fold.

FIG. 1 shows the protective hood 100 as a unitary construction, but the hood also could be formed from two or more panels. In another embodiment, head portion 102 and bib portion 104 may be separable portions that can be joined, e.g., joined with a seal. For example, the head portion and bib portion could be formed separately and joined together, e.g. at a seam, fold, or overlap. In some embodiments, one or both of the head portion and the bib portion could be formed from single panel or multiple panels that are joined together. Such constructions are known in the art and need not be illustrated here. In embodiments wherein the particle barrier layer is formed from multiple panels, the panels can be joined by adhesives, welding, stitching or other methods known in the art. In some embodiments, the particle barrier layer comprises at least two panels joined by a seam. The seams can be sealed using, for example, seam tape, while in other embodiments, the seams are left unsealed.

Hoods according to embodiments described herein include at least a first layer adjacent to a particle barrier layer. In various embodiments, the first layer may be a support layer laminated to a surface of the particle barrier layer, an outer layer external to the particle barrier layer (opposite a wearer), or an inner layer internal to the particle barrier layer (closer to the wearer). In some embodiments, the first layer and particle barrier layer are joined along at least a portion of the first peripheral edge. Additionally or alternatively, the first layer and particle barrier layer may be joined along at least a portion of the second peripheral edge. The first layer and particle barrier layer may be joined along either peripheral edge by any known means, such as but not limited to, stitching, an adhesive, welding, ultrasonic bonding, lamination, hook and loop closures or a combination thereof. In some embodiments, the first layer comprises at least two panels joined by a seam. In some embodiments the seam of the first layer is offset from the seam of the particle barrier layer.

The hood may include one or more layers in addition to the first layer. For example, the hood may include from one to ten additional layers, e.g., two additional layers or three additional layers. These additional layers may be arranged depending on the desired end use of the hood. For example, additional layers may be disposed in the hood internally, externally, or both, relative to the particle barrier layer and/or the first layer. In some embodiments, the hood includes at least two outer layers external to the particle barrier layer. Additionally or alternatively, the hood includes at least two inner layers internal to the particle barrier layer. In some embodiments, the hood may include least one outer layer external to the particle barrier layer (opposite the wearer) and at least one inner layer internal to the particle barrier layer (closer to the wearer). The additional layers may provide the wearer with additional flame protection or increase the user's comfort when wearing the hood. In some embodiments, the particle collection surface of the particle barrier layer can be accessible. Thus, if any layer is adjacent to the particle collection surface, the hood can include an aperture through such layers that provides access to the particle collection surface.

More generally, when the hood includes a first layer that is adjacent to the particle barrier layer, the hood may include one or more additional layers adjacent to the opposite side of the particle barrier layer, such that the particle barrier layer is between the first layer and the one or more additional layers. Alternatively, when the hood includes a first layer that is adjacent to the particle barrier layer, the hood may include one or more additional layers adjacent to the opposite side of the first layer, such that the first layer is between the particle barrier layer and the one or more additional layers. In some embodiments when the hood includes a first layer that is adjacent to the particle barrier layer, the hood may include at least two additional layers, with at least one on either side of the structure comprising the particle barrier layer and first layer. That is, when the first layer is adjacent to the particle barrier layer, the hood may include one or more additional layers adjacent to either the first layer or the particle barrier layer and one or more additional layers adjacent to the other of the first layer or the particle barrier layer, such that the particle barrier layer and the first layer are both between the additional layers.

Figure 2A:
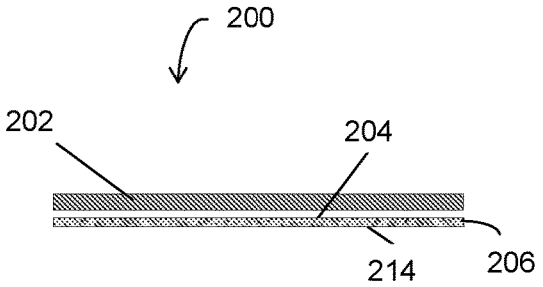
FIGS. 2*a*-2*f* are partial cross-sectional views of exemplary configurations of the particle barrier layer, a first layer, and optional additional layers.
Figure 2E:
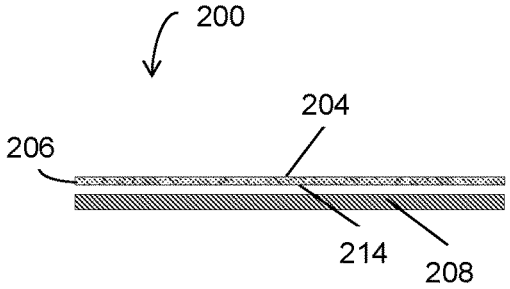
Figure 2B:
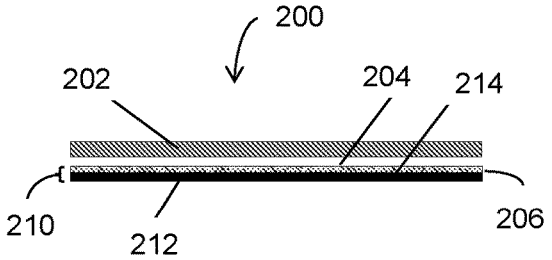
Figure 2F:
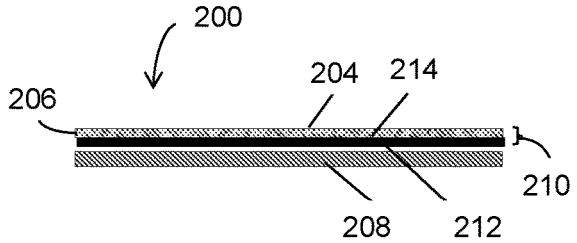
Figure 2C:
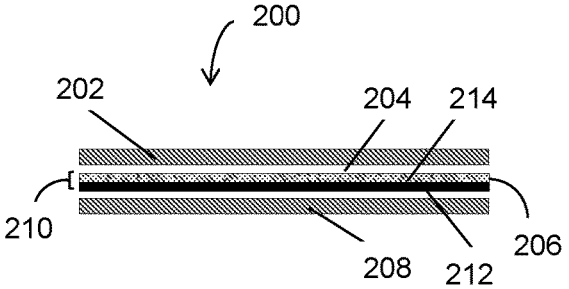
Figure 2D:
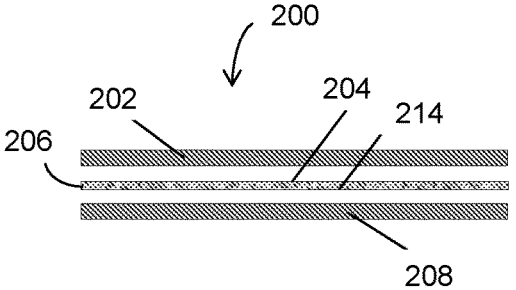

FIGS. 2*a-f* illustrate cross-section views of exemplary configurations of hoods configurations 200 including a particle barrier layer, an outer layer, and/or an inner layer. For reference, the exterior environment is above the configuration and the wearer or hood interior is below the configuration. FIGS. 2*a*-2*d* show partial cross-sectional views of an outer layer 202 adjacent to a particle collection surface 204 of a particle barrier layer 206. FIGS. 2*c*-2*f* show an inner layer 208 internal to the particle barrier layer 206 (closer to the wearer). FIGS. 2*b*, 2*c*, and 2*f* show a laminate 210 comprising a particle barrier layer 206 and a support layer 212.

FIGS. 2*a*-2*d* show a partial cross-sectional view of an outer layer 202 adjacent to a particle collection surface 204 of a particle barrier layer 206. To permit access to the particle collection surface 204, a configuration as shown in FIGS. 2*a*-2*d*, includes an aperture (not shown) through the outer layer 202 or between the outer layer 202 and the particle barrier layer 206 at a peripheral edge (not shown). In the configurations shown in FIGS. 2*a*-2*d*, the outer layer 202 is not joined across the surface with the particle barrier layer 206, but may be joined continuously or discontinuously along the edges (not shown) of the outer layer 202 and the particle barrier layer 206. Thus, the outer layer 202 may be separable from the particle barrier layer 206. In other embodiments, the particle barrier layer is an outer layer and no aperture is needed.

FIGS. 2*c*-2*f* show an inner layer 208 internal to the particle barrier layer 206 (closer to the wearer). In embodiments shown in FIGS. 2*e* and 2*d*, the inner layer 208 is adjacent to the interior surface 214 of the particle barrier layer. As access to the interior surface 214 of the particle barrier 206 is not required, the inner layer 208 may be joined to the particle barrier layer 206 continuously or discontinuously across the interior surface 214 surface or continuously or discontinuously along the edges (not shown). In some embodiments, some or all of the layers in the hood configuration 200 shown in FIGS. 2*e* and 2*f* may be separable, but separability is not necessary since the particle collection surface 204 is exposed to the environment.

FIGS. 2*b*, 2*c*, and 2*f* show a laminate 210 comprising a particle barrier layer 206 and a support layer 212. Depending on the type of particle barrier layer 206, it may be desired to use a support layer 212 laminated to the particle barrier layer 206. The support layer 212 increases the durability of the particle barrier layer 206. The support layer 212 may be adjacent to the particle barrier layer 206 as shown in FIGS. 2*b*, 2*c*, and 2*f* and may be joined to the interior surface 214 of the particle barrier layer 206 with a continuous or discontinuous adhesive. Each layer in FIGS. 2*a*-2*f* is shown as an individual layer, but in some embodiments, any layer may comprise multiple layers, as described above.

The particle barrier layer and first layer are joined to each other along at least a portion of the first peripheral edge and along at least a portion of the second peripheral edge. When the hood includes layers in addition to the first layer, those layers may be joined to the particle barrier layer, to the first layer, and/or to each other along at least a portion of the first peripheral edge and along a portion of the second peripheral edge. The particle barrier layer, first layer, and any additional layers may be joined along either peripheral edge by any known means, such as but not limited to, stitching, an adhesive, lamination, or a combination thereof.

In embodiments having an aperture, the aperture may be located along one of the peripheral edges or may be located elsewhere. When an aperture is located along a peripheral edge, all layers may be joined along any portion of the peripheral edge that does not include the aperture. Along any aperture portion of a peripheral edge, however, at least the particle barrier layer will be on one side of the aperture with the particle collection surface facing the aperture and a portion of the peripheral edge of the particle barrier layer forming approximately half of the aperture perimeter. At least one other layer will be on the other side of the aperture with a portion of the peripheral edge of that layer forming approximately the other half of the aperture perimeter. Along the aperture portion of the peripheral edge, the particle barrier layer will be finished separately from the at least one other layer on the other side of the aperture.

More generally, along any aperture portion of a peripheral edge, at least one single layer or combination of layers will be finished separately from at least one other single layer or combination of layers. In some embodiments having an aperture in a peripheral edge, each layer may be finished individually along the aperture portion of the peripheral edge, such that no two layers are joined to each other along the aperture portion of the peripheral edge. In other embodiments having an aperture in a peripheral edge, one or more layers on one side of the aperture may be finished together. That is, one or more layers on one side of the aperture may be joined to each other along the aperture portion of the peripheral edge. Likewise, one or more layers on the opposite side of the aperture may be joined to each other along the aperture portion of the peripheral edge.

Figure 3A:
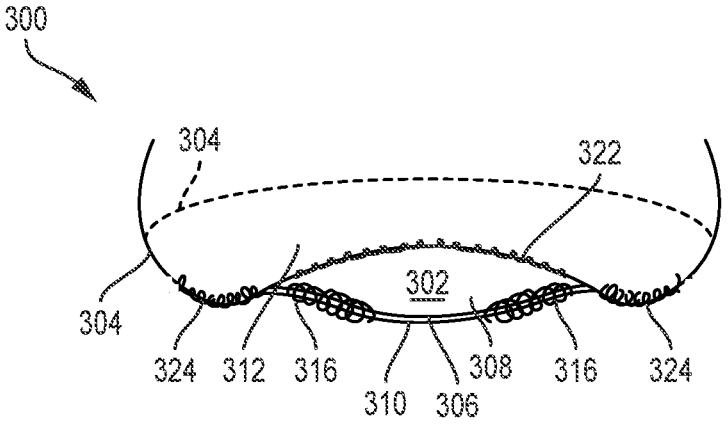
FIGS. 3*a*-3*b* are partial back views of protective hoods according to embodiments described herein showing joining of layers at an aperture.
Figure 3B:
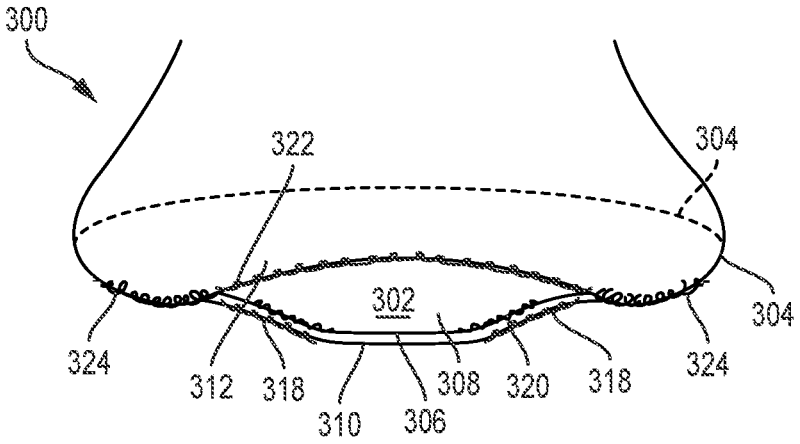

FIGS. 3*a* and 3*b* show partial back views of hoods 300 according to embodiments described herein. FIGS. 3*a* and 3*b* both show a hood 300 including an aperture 302 along a portion of a peripheral edge 304. The hoods include a particle barrier layer 306 having a particle collection surface 308, an inner layer 310 adjacent to the interior surface (not shown) of the particle barrier layer 306, and an outer layer 312 adjacent to the particle collection surface 308. The aperture 302 provides access to the particle collection surface 308. The particle barrier layer 306 and the inner layer 310 are on one side of the aperture 302 and the outer layer 312 is on the other side of the aperture 302. FIG. 3*a* shows the particle barrier layer 306 and the inner layer 310 finished together (joined at the peripheral edge 304) by stitches 316 along the aperture 302 portion of the peripheral edge 304. FIG. 3*b* shows the particle barrier layer 306 and the inner layer 310 finished separately (not joined at the peripheral edge 304) by stitches 318, 320 along the aperture 302 portion of the peripheral edge 304. FIGS. 3*a* and 3*b* both show the outer layer 312 finished separately by stitches 322 along the aperture 302 portion of the peripheral edge 304. The outer layer 312, particle barrier layer 306 and inner layer 310 may all be joined together with stitches 324 along the peripheral edge outside of the aperture 302 portion of the peripheral edge 304. FIGS. 3*a* and 3*b* show stitches to join the layers, but other means of joining may be used, including but not limited to adhesive, lamination or combinations thereof. FIGS. 3*a* and 3*b* show only two layers in addition to the particle barrier layer, but in other embodiments, either the inner layer 310 or the outer layer 312 of FIGS. 3*a*-*b* could comprise multiple layers.

In some embodiments, the hood comprises two or more particle barrier layers. Each particle barrier layer comprises an interior surface and a particle collection surface, as described above. The two or more particle barrier layers may be adjoining or may be separated by other layers. In some embodiments, the particle collection surface of each particle barrier layer is accessible. In some embodiments, a hood comprising multiple particle barrier layers comprises multiple apertures. In some embodiments, a hood comprises at least one aperture for each particle barrier layer.

A hood according to embodiments herein may include a closure to secure the aperture in a closed configuration when access to the particle barrier layer is not required. When closed the closure may be sealable to prevent additional particulates from entering. Thus, in one embodiment, the aperture may be closeable and further may be sealably closeable. For example, the hood may include one or more slits folds, overhangs, buttons, hook and loop closures (e.g., Velcro® fasteners), snaps, or any other suitable means for securing the aperture in a closed configuration. In some embodiments, the securing mechanism is non-metallic. In some embodiments, the aperture is reversibly secured, such that the aperture can be opened to access the particle barrier layer and then re-secured.

In some embodiments, at least two layers are separable. The particle barrier layer, the first layer, or any additional layer may be separable from an adjacent layer. As used herein, the term "separable" is intended to refer to a component which is not substantially bonded to an adjacent component across its surface, but may be bonded around its perimeter to the perimeter of adjacent component(s) by stitching or other means to fix the components together. Two layers that are adjacent and separable may be pulled apart to allow inversion of the construction.

Useful particle barrier layers will prevent or inhibit at least a portion of the particles from traveling from the external environment of a wearer through the hood and into the interior of the hood where the particulates could contact the wearer. The particle barrier layer, however, should also be cleanable, or have the ability to release at least a portion of, for example, some or all of the collected particulates, so that the hood including the particle barrier layer is suitable for repeated use. Thus, in some embodiments, the particle barrier layer is configured to release particulates. In some embodiments, particulates collected within the particle barrier layer are released back through the particle collection surface. In some embodiments, the particle collection surface and/or the particle barrier layer is configured to release particulates. Releasing particulates means that the particulates can be removed from the particle barrier layer by a cleaning method, for example by wiping, spraying down with water, laundering, applying reduced pressure (e.g., vacuum cleaning), or any combination of the forgoing.

Examples of materials useful as particle barrier layers include porous and non-porous membranes. Suitable particle barrier layers are capable of inhibiting passage of particulates having a diameter greater than or equal to 0.027 micrometers, or greater than or equal to 0.03 micrometers, or greater than or equal to 0.04 micrometers, or greater than or equal to 0.05 micrometers, or greater than or equal to 0.06 micrometers, or greater than or equal to 0.07 micrometers, or greater than or equal to 0.08 micrometers, or greater than or equal to 0.09 micrometers, or greater than or equal to 0.1 micrometers. The membrane may be air permeable or air impermeable. The membrane may provide breathability as defined as the ability to transport moisture through the membrane. In addition, the membrane may be liquid water resistant to prevent penetration of particulates in the liquid water. In some embodiments, the particle barrier layer may be polytetrafluoroethylene (PTFE), expanded PTFE (ePTFE), another fluoropolymer, polyurethane, polyolefin (e.g., polyethylene, polypropylene), polyimide (e.g. NANO® and NANOFLEX® polyimides), polyester, silicone, or a combination thereof. In some embodiments, the PTFE, ePTFE, other fluoropolymer, polyolefin, polyimide, or polyester particle barrier layer may be in the form of fibers.

Particle barrier layers in embodiments described herein may comprise a fluoropolymer having a microstructure of nodes interconnected by fibrils, which provide a porous structure. In some embodiments, the microstructure is asymmetric, meaning that the porous structure comprises multiple regions through the thickness of the structures, and at least one region has a microstructure that is different from the microstructure of a second region. Examples of fluoropolymers having such asymmetric microstructures are provided in U.S. Pub. No. 2011/0271416, which is incorporated herein by reference in its entirety.

The particle barrier layer or any other layer of the hoods disclosed herein may optionally include a coating. In some embodiments, the coating is moisture vapor breathable, such as for example an air impermeable moisture vapor breathable polyurethane coating. Other optional coatings include node and fibril fluoropolymer based coatings. In some embodiments, the particle barrier layer or any other layer may include an impregnated monolithic moisture vapor permeable polymer. In other embodiments, the particle barrier layer or any other layer may be uncoated.

In some embodiments including an outer layer, examples of materials useful as the outer layer include, but are not limited to 3-D printed polymers, flocked materials, and textiles. Optionally, the outer layer may be a knit, woven or nonwoven, or fleece. In some embodiments, the outer layer is flame resistant. In some embodiments, the outer layer is a flame resistant textile layer. Optionally the outer layer may be formed from natural fibers (e.g., cotton, wool), synthetic fibers (e.g. rayon, LYCRA® spandex), melamine, synthetic polymers (e.g., aramid, polyamide, polybenzimidazole (PBI), polybenzoxazole (PBO), polydiimidazo pyridinylene dihydroxy phenylene (PIPD), modacrylic), or blends thereof. In some embodiments, the outer layer may be flame resistant and may be formed from FR cotton, wool, FR rayon, modacrylic, aramid, polyamide, PBI, PBO, PIPD, modacrylic, or blends thereof.

In some embodiments including an inner layer, examples of materials useful as the inner layer include, but are not limited to 3-D printed polymers, flocked materials, and textiles. Optionally, the inner layer may be a knit, woven or nonwoven, or fleece. In some embodiments, the inner layer is flame resistant. In some embodiments, the inner layer is a flame resistant textile layer. Optionally the inner layer may be formed from natural fibers (e.g., cotton, wool), synthetic fibers (e.g. rayon, LYCRA® spandex), melamine, synthetic polymers (e.g., aramid, polyamide, polybenzimidazole (PBI), polybenzoxazole (PBO), polydiimidazo pyridinylene dihydroxy phenylene (PIPD), modacrylic), or blends thereof. In some embodiments, the inner layer may be flame resistant and may be formed from FR cotton, wool, FR rayon, modacrylic, aramid, polyamide, PBI, PBO, PIPD, modacrylic, or blends thereof.

In embodiments including an inner layer and an outer layer, the inner and outer layers may be the same material or different materials. Likewise, the inner and outer layers may have similar properties or different properties. In some embodiments, an outer layer or inner layer provides thermal protection. In some embodiments, the hoods described herein are useful for cold weather use where particulate blocking is needed. For example, hoods according to embodiments described herein may be useful as ski hoods.

In some embodiments, as described above, the interior surface of the particle barrier may be laminated to a substrate. The substrate may be any material that can provide support and/or durability to a particle barrier layer. For example, the substrate may be a knit, woven or nonwoven, or fleece. In other examples, the substrate may be in the form of a plurality of lines, a grid, a monolithic coating, etc. Optionally the substrate may be formed from natural fibers (e.g., cotton, wool), synthetic fibers (e.g. rayon, LYCRA® spandex), melamine, synthetic polymers (e.g., aramid, polyamide, polybenzimidazole (PBI), polybenzoxazole (PBO), polydiimidazo pyridinylene dihydroxy phenylene (PIPD), modacrylic), or blends thereof.

In some embodiments, a layer of a heat reactive material can be applied to at least a portion of at least one of the surfaces of the first, second, third or any subsequent layer and/or at least one surface of the barrier layer. The heat reactive material can comprise a polymer resin-expandable graphite material, wherein the expandable graphite has an expansion of at least 900 μm upon heating to 280° C. The heat reactive materials and methods for using the heat reactive materials can be any of those as found in U.S. Pat. No. 8,722,145; US 2009/0110919; US 2009/0246485; or EP 2205110, all of which are incorporated herein by reference in their entirety. In some embodiments, the particle barrier layer can be laminated to a substrate, wherein the heat reactive material can be used as an adhesive layer adhering the particle barrier layer to the substrate.

Each layer within the hood, including the particle barrier layer and any substrate laminated thereto, should have sufficiently low stiffness and flexibility so that it can be comfortably used in a hood. Moreover, a hood for first responders according to embodiments herein must be flexible enough for quick donning and doffing. Thus in some embodiments the particle barrier layer alone or in combination with a substrate has a warp stiffness of 0.0003 to 4.5 gram force centimeter$^2$/centimeter (gf·cm$^2$/cm) (e.g., 0.03 to 0.60 gf·cm$^2$/cm, or 0.05 to 0.09 gf·cm$^2$/cm). In some embodiments, the particle barrier layer alone or in combination with a substrate has a weft stiffness 0.0003 to 5.4 gf·cm$^2$/cm (e.g., 0.01 to 0.70 gf·cm$^2$/cm, or 0.03 to 0.06 gf·cm$^2$/cm). In addition, in some embodiments the particle barrier layer of a hood described herein is stretchable to increase comfort and ease of donning and doffing.

Particle barrier layers may be any useful weight if they have the desired flexibility and stretchability. For example, in some embodiments a particle barrier layer/substrate combination according to embodiments described herein may have a weight of from 4 to 550 grams per square meter (gsm). In some embodiments, the weight of the particle barrier layer/substrate may be from 40 to 300 gsm. And in some embodiments, the weight of the particle barrier layer/substrate may be from 75 to 130 gsm.

The particle barrier layers described herein should be durable to withstand conditions encountered by a wearer. In some embodiments, the particle barrier layers described herein have a ball burst strength of 3 to 225 lb. In some embodiments, the particle barrier layers described herein have a ball burst strength of 30 to 100 lb. In some embodiments, the particle barrier layers described herein have a ball burst strength of 50 to 85 lb, based on the average of 5 ball burst measurements as determined by ASTM D3787.

In some embodiments, a hood disclosed herein includes a face opening that engages with a face mask to form an additional protective seal against the intrusion of particulates to the skin of the wearer. In some embodiments, the hood includes a heat resistant elastomer on the inner surface of the hood adjacent to the first peripheral edge of the face opening. The heat resistant elastomer is located adjacent to the first peripheral edge of the face opening so that it is configured to engage the face mask. For example, in some embodiments, the heat resistant elastomer on the inside of the hood frictionally engages with the face mask to secure the hood to the face mask. In some embodiments, the heat resistant elastomer prevents the hood from slipping off the face mask. In some embodiments, the heat resistant elastomer prevents gaps from forming between the hood and the face mask. Optionally, the heat resistant elastomer is a silicone elastomer. The heat resistant elastomer may be applied during the manufacturing of the disclosed hood, it can be applied by a user or at the point of sale via a kit comprising the heat resistant elastomer as a flowable fluid or gel that is subsequently hardened or cured. In still other embodiments, the heat resistant elastomer may be a separate component that is constructed to fit around a periphery of the face opening and the separate component may be applied to the face opening via any known bonding technique, for example, sewing, adhesive bonding and/or lamination techniques.

Figure 4:
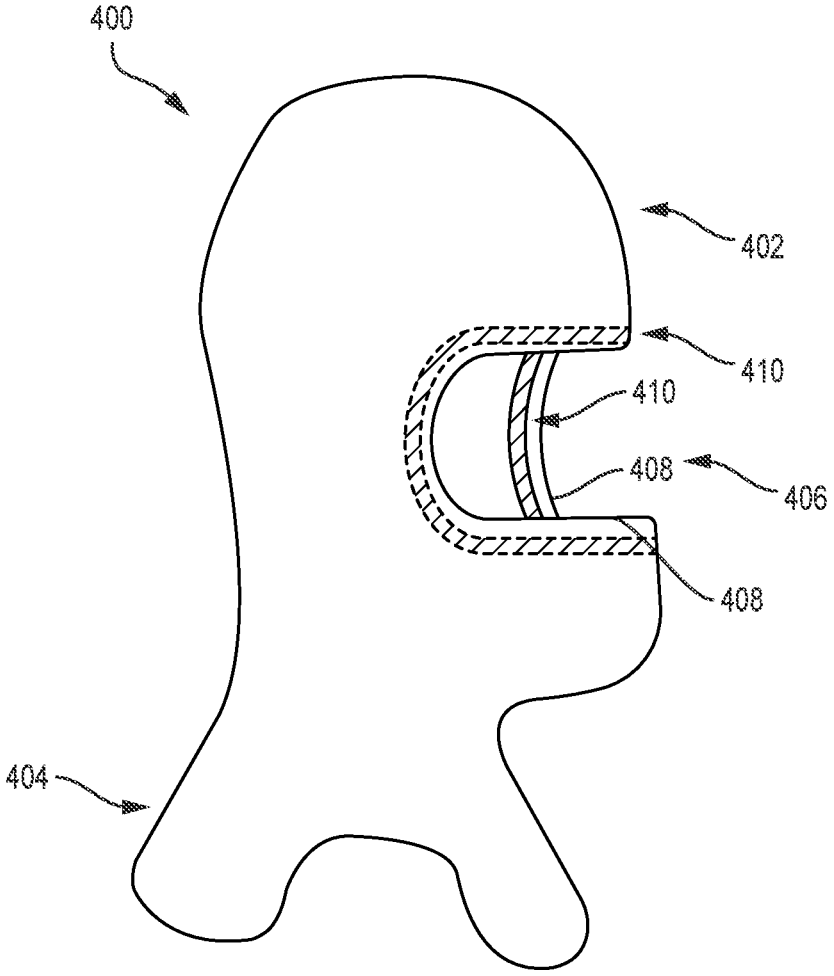
FIG. 4 is a side view of a protective hood according to embodiments described herein, wherein the hood includes a heat resistant elastomer.

FIG. 4 is a side perspective view of a protective hood 400 according to embodiments described herein. FIG. 4 illustrates an embodiment including a head portion 402 integral with a bib portion 404. The head portion 402 includes a face opening 406 defined by a first peripheral edge 408. The hood 400 includes a heat resistant elastomer 410 located adjacent to the first peripheral edge 408 such that it is configured to engage a face mask (not shown).

Often first responders don personal protective gear very quickly. The speed with which a first responder must prepare often allows little time to ensure protective gear is properly configured, such as ensuring a protective hood is properly positioned on a face mask. In some embodiments, a hood disclosed herein includes a visual indicator to indicate when the hood is properly positioned with respect to a face mask. As one example, a hood according to embodiments described herein may include a seam around the first peripheral edge that is a different color than the color of the external surface of the hood. If the peripheral edge color is not visible all the way around the peripheral edge, the hood is properly positioned on the mask. Optionally, the peripheral edge may include a seam sewn using thread of a color different from the color of the external surface of the hood. Again, if the seam color is not visible all the way around the peripheral edge, the hood is properly positioned on the face mask. Optionally, the peripheral edge of the innermost layer may include a material of a different color located adjacent to the first peripheral edge such that it is configured to engage a face mask. This material, if not visible, would indicate that the hood is not properly positioned. Such a color difference would allow a colleague of a first responder to quickly assess whether the first responder's hood is properly positioned on the face mask and to signal whether adjustment is needed.

Figure 5:
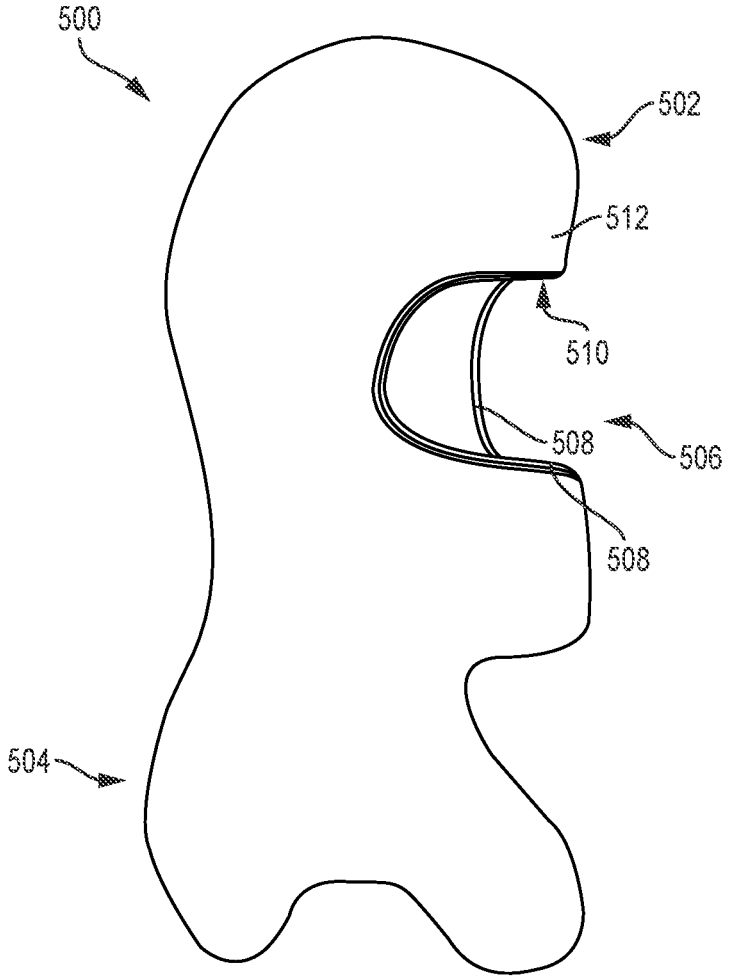
FIG. 5 is a side view of a protective hood according to embodiments described herein, wherein the hood includes a visual indicator.

FIG. 5 is a side perspective view of a protective hood 500 according to embodiments described herein. FIG. 5 illustrates an embodiment including a head portion 502 integral with a bib portion 504. The head portion 502 includes a face opening 506 defined by a first peripheral edge 508. The hood 500 includes a seam 510 around the first peripheral edge 508 that is a different color than the color of the external surface 512 of the hood 500.

Face masks which may be used in accordance with the present inventive hood construction may include respiratory masks (e.g., with a canister), chemical protective masks, filtering masks, powered air personal respirators (PAPR), self-contained breathing apparatus (SCBA), ski goggles, and the like.

Hoods comprising the particle barrier layers according to embodiments described herein have particle blocking efficiencies of up to 99.999%, when tested according to the method described herein. In some embodiments, a hood comprising the particle barrier layer described herein has a particle blocking efficiency of 90% or greater. In some embodiments, a hood comprising the particle barrier layer described herein has a particle blocking efficiency of 95% or greater. In some embodiments, a hood comprising the particle barrier layer described herein has a particle blocking efficiency of 98% or greater.

Experimental

Unless otherwise noted, all ePTFE membranes, laminates and fabrics are available from W. L. Gore and Associates, Inc. Unless otherwise noted, the ePTFE membranes were produced according to U.S. Pat. No. 3,953,566.

Ball Burst Test

Particle barrier layers laminated to a substrate were tested in accordance with ASTM D3787 Standard Test Method for Bursting Strength of Textiles-Constant-Rate-of-Traverse (CRT) Ball Burst Test Example (1), a 2 layer 40-45 gram per square meter (gsm) laminate comprising an ePTFE membrane (having a bubble point of 17 psi, mass of 9.5 gsm and a thickness of 24 micrometers) as a particle barrier layer laminated to a 0.7 ounce per square yard (osy) (17 gsm) NOMEX® nonwoven fabric substrate (style E-88 307 63 inch natural, available from DuPont, Wilmington, Del.), was tested according to the test method and a ball burst of 30.63 pound force (lbf) (136.2 newton) was determined.

Example (2), a 2 layer 70-75 gsm laminate comprising an ePTFE membrane (having a bubble point of 19 psi, mass of 41 gsm and a thickness of 91 micrometers) as a particle barrier layer laminated to a 0.7 osy (17 gsm) NOMEX® nonwoven fabric substrate (style E-88 307 63 inch natural, available from DuPont, Wilmington, Del.), was tested according to the test method and a ball burst of 52.10 lbf (231.8 newton) was achieved.

gsm) NOMEX® knitted textile, style 1919, available from Draper Knitting, Canton, Mass.

The two barrier layers tested were Example (4), an ePTFE membrane (having a bubble point of 17 psi, mass of 9.5 gsm and a thickness of 24 micrometers) laminated to a 1.8 osy (43 gsm) NOMEX® knit (style number 32406.99, available from SSM, Spring City, Tenn.) for a total weight of about 72 gsm, and Example (5), a CROSSTECH® black moisture barrier (part #WNPZ100000M, available from W. L. Gore and Associates, Newark, Del.). CROSSTECH® Black Moisture barrier is a 2-layer laminate made from an ePTFE membrane as the particle barrier layer laminated to a NOMEX® woven fabric.

TABLE 1

| | Particle Diameter (nm) | | | | | |
|---|---|---|---|---|---|---|
| Example | 102-151 | 151-202 | 202-300 | 300-496 | 496-737 | 737-982 |
| 2-layer knit (control) | 89.39% | 88.36% | 86.38% | 83.73% | 79.97% | 78.49% |
| (4) | >99.999% | >99.999% | >99.999% | >99.999% | >99.999% | >99.999% |
| (5) | >99.999% | >99.999% | >99.999% | >99.999% | >99.999% | >99.999% |

Kawabata Stiffness Test

Stiffness of a particle barrier layer laminated to a substrate was determined using a Kawabata KES-FB2 Auto A tester. The software used was KES-FB System version 8.04E from Kato Tech Co., LTD. For measuring the stiffness of a sample, Measurement Program FB2-A was used with the Sample set as Fabrics/Films, the Measurement mode was set to one cycle and the sensitivity was set to 20. The sample width was 20 centimeters (cm) and the curvature was 2.5 $cm^{-1}$. If the rotation was unable to complete, the sensitivity was adjusted upwards to 50. If the rotation can still not be completed, the sample width was cut down. If the system was unable to register the sample because it is too light, the sensitivity was adjusted downwards to 10 in order to obtain a reading. Samples were measured in the warp and/or weft direction. Films were measured in the machine and/or transverse direction.

Stiffness tests were conducted on a relatively heavier weight laminate to determine flexibility, because it was clear that the relatively heavier weight laminates would have the requisite strength (based on the ball burst strength of the lighter weight samples).

Example (3), a 2 layer 285-295 gsm laminate comprising ePTFE membrane (produced according to U.S. Pat. No. 5,418,054 and having a moisture vapor transmission rate of >10,000 grams/$m^2$/24 hrs, a mass of 40.5 gsm and a thickness of 52 micrometers) particle barrier layer laminated to an 8.0 osy (190 gsm) rib knit fabric substrate (NOMEX® knitted textile, style 1918, available from Draper Knitting, Canton, Mass.), was determined to have a Warp B-MEAN of 0.1862 (gf·$cm^2$/cm) and a Weft B-MEAN of 0.063 (gf·cm2/cm). The laminate has a sufficiently low stiffness so that it can be comfortably used in a hood.

Particle Barrier Test

Particle barrier efficiency was measured using a TSI CPC, Model 377200 and a TSI Electrostatic Classifier, Model 3080. The temperature was 21° C., relative humidity was 48% and the barometric pressure was 783 millimeters (mm) Hg. The contaminant was a polydispersed latex sphere aerosol. 90 mm flat disk-shaped samples were tested from each barrier layer. The control was 2 layers of 8 osy (190

The results of TABLE 1 show that the barrier layers of the disclosure can provide an excellent barrier to particles having a size range that approximates the particles found in soot.

Contamination and Cleaning

Example (6) (an ePTFE laminate, part # KBDU600000B, available from W.L. Gore and Associates, Newark, Del.) with ePTFE as the particle barrier layer laminated to a NOMEX® knit fabric, a comparative NOMEX® Nano nonwoven (available from DuPont, Wilmington, Del.), and a PTFE woven material were tested for their cleanability. Prior to contaminating the samples, a picture was taken of each clean sample using an Apple iPhone 6. The picture was uploaded to a computer running ImageJ software which is an open source JAVA image processing program. Using the "Measure" function, the value for the brightness of the photo was obtained.

The test samples were contaminated using a Martindale Abrasion unit, set to abrasion setting "C". 0.05 g of CONDUCTEX® 7060 powder was placed on one surface of each sample. The abradant head was then put on top of the powder and the abrasion was run for 32 movements (2 complete cycles). The abradant head did not have any weight atop the rod connecting it to the abrasion unit. The abradant was about 2 osy (47 gsm) ePTFE laminate with the ePTFE facing towards the sample. An image of the treated surface of the contaminated sample was taken with an iPhone 6. The sample was then cleaned using the Martindale Abrasion unit. The sample was cleaned by using 2 layers of CLOROX® wipes as the abradant. The abrasion machine ran for 8 movements (½ cycle) and then the abradant head was replaced with a clean one, also using 2 layers of CLOROX® wipe as the abradant. Another 8 movements (½ cycle) were run with the fresh abradant, thus completing one cycle. An image of the cleaned sample was recorded using an iPhone 6. Each of the images of the samples before contamination, after contamination and after cleaning was recorded by the same camera, under identical lighting conditions.

For the contaminated and the cleaned samples, only the brightness of the area that was contacted by the Martindale abrader unit was measured. The brightness of the abraded area for each sample was determined. The percent cleanability was determined using the following calculation and results are shown in Table 2.

$$Z=100*(1-(c-y)/(c-x))$$

Z=% Cleaned
c=Brightness Measurement value from Control sample
x=Brightness Measurement value from Contaminated sample
y=Brightness Measurement value from Contaminated then Cleaned sample

TABLE 2

| | Example (6) | NOMEX ® Nano | PTFE woven |
|---|---|---|---|
| Control | 232.703 | 204.865 | 224.642 |
| Contaminated | 30.117 | 51.356 | 122.14 |
| Cleaned | 85.744 | 63.359 | 126.29 |
| % Cleaned | 27% | 8% | 4% |

The results in Table 2 show that the Example (6) comprising an ePTFE particle barrier layer has much greater ability to be cleaned that do commercial alternatives.

Friction Test

The coefficient of friction for several samples was measured using an IMass 2100 and using 3M™ BUMPON™ Protective Product rollstock as the friction substrate. The coefficient of friction of a 2.54 cm wide strip of Nomex/Lenzing blend knit from Green Mountain knitting was measured both in the warp and weft direction. The fabric strip was wrapped around the sled to ensure that only the tested sample was in contact with the testing surface throughout testing. Using the same blend knit material, a custom made strip of silicone elastomer approximately 13 millimeters wide was applied to the knit textile and the strip was allowed to cure for over 10 days. The coefficient of friction of the silicone strip was measured using the same techniques as above. Each test consisted of 2560 measurements of the coefficient of friction once at steady state, and the results represent the average of those measurements. The results of the test can be found in Table 3.

TABLE 3

| Sample | Coefficient of Friction (average) |
|---|---|
| Silicone elastomer sample | 2.06 |
| Textile (warp) | 1.79 |
| Textile (fill) | 1.77 |

Persons skilled in the art will readily appreciate that various aspects of the present disclosure can be realized by any number of methods and apparatus configured to perform the intended functions. It should also be noted that the accompanying drawing figures referred to herein are not necessarily drawn to scale, but may be exaggerated to illustrate various aspects of the present disclosure, and in that regard, the drawing figures should not be construed as limiting.

Smoke Test

The ability for smoke to pass through a stitched seam was observed by using a Liquid Fog machine (Model FM1000-A, available from Shenzhen Qiaohua Industries Limited). A specimen holder allowing a 60 millimeter opening was mounted in front of the Liquid Fog machine. A pressure drop was adjusted from 0.22 inches (5.6 millimeters) of water to 0.44 inches (11.1 millimeters) of water depending on the sample. Example (7) was a 3-layer construction wherein the innermost and outermost layers were a NOMEX® knit (part #C18-14161138, available from Majestic Fire Apparel, Lehighton, Pa.) with Example (4) functioning as the particle barrier layer. The material of Example (4) with a seam running through the material was sandwiched in between the inner and outer NOMEX® knit layers. In order to produce the seamed sample of each inner and outer layers, two pieces of the NOMEX® knit were stitched together using a simple seam. The seam allowance was then sewn with an overlock stitch. Finally, the seam allowance was tacked in place with a double sided 3-thread cover stitch. For the barrier layer, two pieces of Example (4) were sewn together with a simple seam followed by an overlock stitch of the seam allowance. Each inner and outer layer contained the seam and the NOMEX® knit fabric. The three layers including the seams of each layer were stacked on top of each other and placed within the test fixture. Comparative A consisted of a seam taken from a finished hood, Innotex Gray (available from Innotex, Ohatchee, Ala.) and consisting of Stedair PREVENT® as a particle blocking layer, and one layer of knit. The portion of the comparative hood tested contained two layers that were stitched together through both layers creating a single seam and placed within the test fixture.

Each sample was oriented in the test fixture such that the exterior surface was facing the upstream side of the smoke; for Example (7) this was one of the layers of the NOMEX-_Lenzing knit and for Comparative A this was the knit layer. Samples were tested as made or received and after 100 wash cycles per NFPA 1851-2014 edition (Section 7.3). Samples were subjected to a minimum of 10 seconds of upstream smoke and observed on the downstream side (visible to the observer) for visual indication of smoke coming through the sample.

TABLE 4

| Example | Sample Preconditioning | Pressure drop (inches of water) | Observation |
|---|---|---|---|
| 7 | Initial | 0.44 | No visible smoke observed |
| 7 | 100 wash cycles | 0.44 | No visible smoke observed |
| Comparative A | As received | 0.04 | Smoke observed exiting the sample through the seam |
| Comparative A | 100 wash cycles | 0.22 | Smoke observed exiting the sample through the seam |

To confirm that smoke did not pass through the materials themselves, comparative A without a seam was tested. No visible smoke was observed.

Results from Table 4 show that that offset seams provide greater reduction in smoke passing through a sample when there are multiple independent seams (including a seam through the particle blocking layer) compared to a single seam with one or more layers containing a particle blocking layer.

The invention of this application has been described above both generically and with regard to specific embodiments. It will be apparent to those skilled in the art that various modifications and variations can be made in the embodiments without departing from the scope of the disclosure. Thus, it is intended that the embodiments cover the modifications and variations of this invention provided they come within the scope of the appended claims and their equivalents.

What is claimed is:

1. A hood for a wearer comprising:

a first layer and a particle barrier layer that at least partially covers the first layer, wherein the particle barrier layer comprises an interior surface toward the wearer and a particle collection surface opposite the interior surface, wherein the first layer comprises at least two panels joined by a first stitched seam, wherein the particle barrier layer comprises at least two panels joined by a second stitched seam, wherein the first stitched seam is offset from the second stitched seam, and wherein the hood comprises:

a) a head portion comprising a first peripheral edge defining a face opening, wherein the first layer and particle barrier layer are joined along at least a portion of the first peripheral edge; and b) a bib portion comprising a second peripheral edge defining a neck opening, wherein the first layer and particle barrier layer are joined along at least a portion of the second peripheral edge, wherein the first layer is not joined to the particle barrier layer along at least a portion of the second peripheral edge to form an aperture, and wherein the particle collection surface is accessible via the aperture between the first layer and the particle barrier layer.

2. The hood of claim 1, wherein the first layer comprises a textile layer.

3. The hood of claim 1, wherein the hood comprises an inner surface and a heat resistant elastomer adhered to the inner surface adjacent to the first peripheral edge of the face opening.

4. The hood of claim 1, wherein the first layer is adjacent to the particle collection surface.

5. The hood of claim 4, wherein the aperture is located along at least a portion of the second peripheral edge between the first layer and the particle barrier layer.

6. The hood of claim 4, wherein the aperture has dimensions sufficient to invert the hood such that the particle collection surface is on the exterior of the hood.

7. The hood of claim 1, wherein the particle barrier layer is oriented such that in use the particle collection surface is on the exterior of the hood.

8. The hood of claim 1, wherein the interior surface of the particle barrier layer is laminated to a substrate.

9. The hood of claim 1, wherein the hood further comprises:

i) a second layer, wherein the particle barrier layer is between the first layer and the second layer; or ii) a second layer, wherein the first layer is between the particle barrier layer and the second layer; or iii) a second layer and a third layer, wherein first layer and the particle barrier layer are in between the second layer and the third layer.

10. The hood of claim 9, wherein the particle barrier layer is joined to at least one of the first layer, the second layer and the third layer along the portion of the second peripheral edge by stitching, an adhesive, lamination, or a combination thereof.

11. The hood of claim 9, wherein i) the first layer and the second layer are joined to each other along at least a portion of the second peripheral edge; or ii) the first layer, the second layer and the third layer are joined to each other along at least a portion of the second peripheral edge.

12. The hood of claim 1, wherein at least one of the first layer and the Particle barrier layer is a flame resistant textile layer.

13. The hood of claim 1, wherein the hood comprises at least one additional particle barrier layer.

14. The hood of claim 1, wherein at least two of the particle barrier layer, the first layer, the second layer, and/or the third layer that are adjacent are separable.

15. The hood of claim 1, wherein the particle barrier layer comprises a fluoropolymer material, a polyurethane material, or a polyester material.

16. The hood of claim 1, wherein the at least one aperture is a closeable opening comprising a slit, fold, overhang, button, hook and loop closure, snap, hook and loop Velere® fastener, or combination thereof.

17. The hood of claim 1, wherein the first peripheral edge defining the face opening comprises a visual indicator that the face opening is properly configured on a face mask.

18. The hood of claim 17, wherein the external surface of the hood comprises a color, and i) wherein the visual indicator is a seam comprising a color that is different than the color of the external surface of the hood; or ii) wherein the peripheral edge of the face opening comprises a seam sewn using a thread of a color different than the color of the external surface of the hood.

19. A The hood of claim 1, wherein the particle barrier layer is configured to collect particles greater than or equal to 0.027 microns.

20. A hood for a wearer comprising:

a first layer and a particle barrier layer that at least partially covers the first layer, wherein the particle barrier layer comprises an interior surface toward the wearer and a particle collection surface opposite the interior surface, wherein the first layer comprises at least two panels joined by a first stitched seam, wherein the particle barrier layer comprises at least two panels joined by a second stitched seam, wherein the first stitched seam is offset from the second stitched seam, and wherein the hood comprises:

a) a head portion comprising a first peripheral edge defining a face opening, wherein the first layer and particle barrier layer are joined along at least a portion of the first peripheral edge; and b) a bib portion comprising a second peripheral edge defining a neck opening, wherein the first layer and particle barrier layer are joined along at least a portion of the second peripheral edge, wherein the hood comprises an inner surface and a heat resistant elastomer adhered to the inner surface adjacent to the first peripheral edge of the face opening, wherein the first layer is not joined to the particle barrier layer along at least a portion of the second peripheral edge to form an aperture, and wherein the particle collection surface is accessible via the aperture between the first layer and the particle barrier layer.

* * * * *